US008215320B2

(12) United States Patent
Prague et al.

(10) Patent No.: US 8,215,320 B2
(45) Date of Patent: Jul. 10, 2012

(54) COSMETIC COMPACT INCORPORATING AN APPLICATOR HOLDER

(75) Inventors: David Prague, Ringoes, NJ (US); Ludovic LeCaro, Morristown, NJ (US)

(73) Assignee: L'Oreal USA Products, Inc., Paris (FR)

( * ) Notice: Subject to any disclaimer, the term of this patent is extended or adjusted under 35 U.S.C. 154(b) by 387 days.

(21) Appl. No.: 12/130,194

(22) Filed: May 30, 2008

(65) Prior Publication Data

US 2009/0293903 A1 Dec. 3, 2009

(51) Int. Cl.
*A45D 33/00* (2006.01)
*A45D 33/28* (2006.01)

(52) U.S. Cl. ..... 132/293; 132/297

(58) Field of Classification Search ..... 132/293, 132/294, 295, 297, 303, 305, 313, 317, 318, 132/320, 218, 304; 206/581, 823, 15.2; D28/78, D28/82, 91; 220/697, 699, 702, 735, 736, 220/212; 401/125, 126, 128, 129, 130; 15/229.14; 24/3.7; 211/65; 215/390
See application file for complete search history.

(56) References Cited

U.S. PATENT DOCUMENTS

| | | | | | |
|---|---|---|---|---|---|
| 252,603 | A * | 1/1882 | Kennish | 15/257.05 |
| 643,855 | A * | 2/1900 | Williamson | 401/121 |
| 1,501,525 | A | 7/1924 | Croswhite | |
| 4,471,874 | A * | 9/1984 | Morane | 206/581 |
| 4,685,558 | A | 8/1987 | Filiz et al. | |
| D307,196 | S * | 4/1990 | McClure | D28/79 |
| 5,348,031 | A * | 9/1994 | Cloud | 132/317 |
| 5,586,653 | A * | 12/1996 | Taveroff | 206/362 |
| 5,992,427 | A * | 11/1999 | Playe | 132/317 |
| 6,002,651 | A * | 12/1999 | Baccaray | 368/10 |
| 6,484,731 | B1 * | 11/2002 | Lacout | 132/293 |
| 7,044,142 | B2 * | 5/2006 | Gueret | 132/317 |
| 7,047,983 | B2 * | 5/2006 | Manougian et al. | 132/294 |
| 7,117,875 | B2 * | 10/2006 | Bourjal | 132/294 |
| 7,228,863 | B2 * | 6/2007 | Dumler et al. | 132/294 |
| 7,359,287 | B2 * | 4/2008 | Baroche | 368/10 |
| 7,743,775 | B2 * | 6/2010 | Thiebaut | 132/294 |
| 2002/0108629 | A1 * | 8/2002 | Thiebaut | 132/297 |
| 2003/0029471 | A1 * | 2/2003 | Jang | 132/293 |
| 2003/0062060 | A1 * | 4/2003 | Burroughs | 132/297 |
| 2003/0154996 | A1 * | 8/2003 | Bourjal | 132/293 |
| 2003/0217761 | A1 * | 11/2003 | Maelstaf | 132/294 |
| 2004/0154634 | A1 * | 8/2004 | Lee | 132/293 |
| 2004/0173234 | A1 * | 9/2004 | Byun | 132/287 |
| 2004/0182413 | A1 * | 9/2004 | de Laforcade | 132/293 |
| 2006/0169298 | A1 * | 8/2006 | Thiebaut | 132/294 |
| 2007/0131240 | A1 * | 6/2007 | Prague | 132/294 |
| 2008/0041861 | A1 * | 2/2008 | Crawford et al. | 220/697 |
| 2008/0072400 | A1 * | 3/2008 | Dieudonat | 16/422 |
| 2008/0142031 | A1 * | 6/2008 | Francis | 132/200 |
| 2009/0044826 | A1 * | 2/2009 | Eng et al. | 132/295 |

FOREIGN PATENT DOCUMENTS

| | | |
|---|---|---|
| GB | 2179330 | 3/1987 |

* cited by examiner

*Primary Examiner* — Todd Manahan
*Assistant Examiner* — Vanitha Elgart
(74) *Attorney, Agent, or Firm* — Connolly Bove Lodge & Hutz LLP

(57) ABSTRACT

A cosmetic compact includes a base and a cap. The base includes a cosmetic well in which a cosmetic may be disposed. The cap is affixed to the base to form an enclosure, with the cosmetic well disposed therein. The cap includes a cosmetic applicator holder, also disposed within the enclosure, which is adapted to engage and secure a cosmetic applicator opposite the cosmetic well.

17 Claims, 5 Drawing Sheets

COSMETIC COMPACT INCORPORATING AN APPLICATOR HOLDER

BACKGROUND OF THE INVENTION

1. Field of the Invention

The field of the present invention is cosmetic compacts, particularly compacts which incorporate an applicator holder within the compact itself.

2. Background

When consumers purchase powdered cosmetics, one of the most important considerations the purchasing decision is based upon is the color of the powder. Other factors which enter into the purchasing decision is for form of the powder, loose or pressed, and yet another factor is whether a cosmetic applicator is included with the purchase of the powder.

For those powder products which do not include a cosmetic applicator with the purchase of the powder, it is typically a very simple matter to place the powder in a container, e.g., a compact for pressed powder or a tub-style container for loose powder, which includes a window or transparent cover. The same is true for powder products which include an applicator, so long as the applicator is included outside of the powder container. For such consumer products, if the applicator is included inside the container, or if the powder cannot be displayed in some manner through the packaging, then a label with a color spot approximating the color of the powder is often include on the outside of the container or packaging. Approximating the color on the label, as opposed to showing the cosmetic powder itself to display the color, is generally considered less than ideal by consumers. On the other hand, the inclusion of additional packaging for the cosmetic powder, whether in the form of paperboard, a blister pack, or other comparable packaging, adds cost to the product, making such packaging generally less desirable to manufacture.

Alternative packaging designs have been used that still allow the consumer to see the actual color of the product, yet somehow incorporate or include an applicator with the container. These alternatives frequently require either adding significant bulk to the container or reducing the amount of cosmetic powder included in the container so that the applicator can easily fit within the container alongside the powder. Both of these alternatives, however, are less than desirable to both the consumer and manufacturer. To the consumer, the necessary added bulk prohibits easily carrying the container in a personal bag or purse regularly, and the reduced amount of cosmetic powder is less of a value. On the other side, to the manufacturer, added bulk means increased manufacturing and distribution costs, and since less powder translates into less value to the consumer, this could lead directly to lower sales volume.

SUMMARY OF THE INVENTION

The present invention is directed toward a cosmetic compact incorporating an applicator holder. The base of the compact includes a cosmetic well, and a cap is affixed to the base to form an enclosure, with the cosmetic well disposed therein. The cap includes a cosmetic applicator holder disposed within the enclosure. The applicator holder is adapted to engage and secure a cosmetic applicator opposite the cosmetic well.

Additional options may be included as part of the cosmetic compact. In one option, the applicator holder may include one or more applicator supports and one or more applicator clips extending from each applicator support. The applicator supports and applicator clips are adapted to engage the cosmetic applicator and to secure the applicator opposite the cosmetic well. This option may further include two applicator supports and two applicator clips. Additionally, each applicator clip may include a boss member positioned to engage the handle of the cosmetic applicator. Each applicator support may include one or more guide ribs. In another option, the applicator holder is adapted to maintain the cosmetic applicator in a predetermined orientation within the cap. In yet another option, the cap, including the applicator holder, may be formed from a transparent material. The handle of the cosmetic applicator may also be formed from a transparent material.

Accordingly, an improved cosmetic compact incorporating an applicator holder is disclosed. Advantages of the improvements will appear from the drawings and the description of the preferred embodiment.

BRIEF DESCRIPTION OF THE DRAWINGS

In the drawings, wherein like reference numerals refer to similar components.

DETAILED DESCRIPTION OF THE PREFERRED EMBODIMENTS

Figure 1:
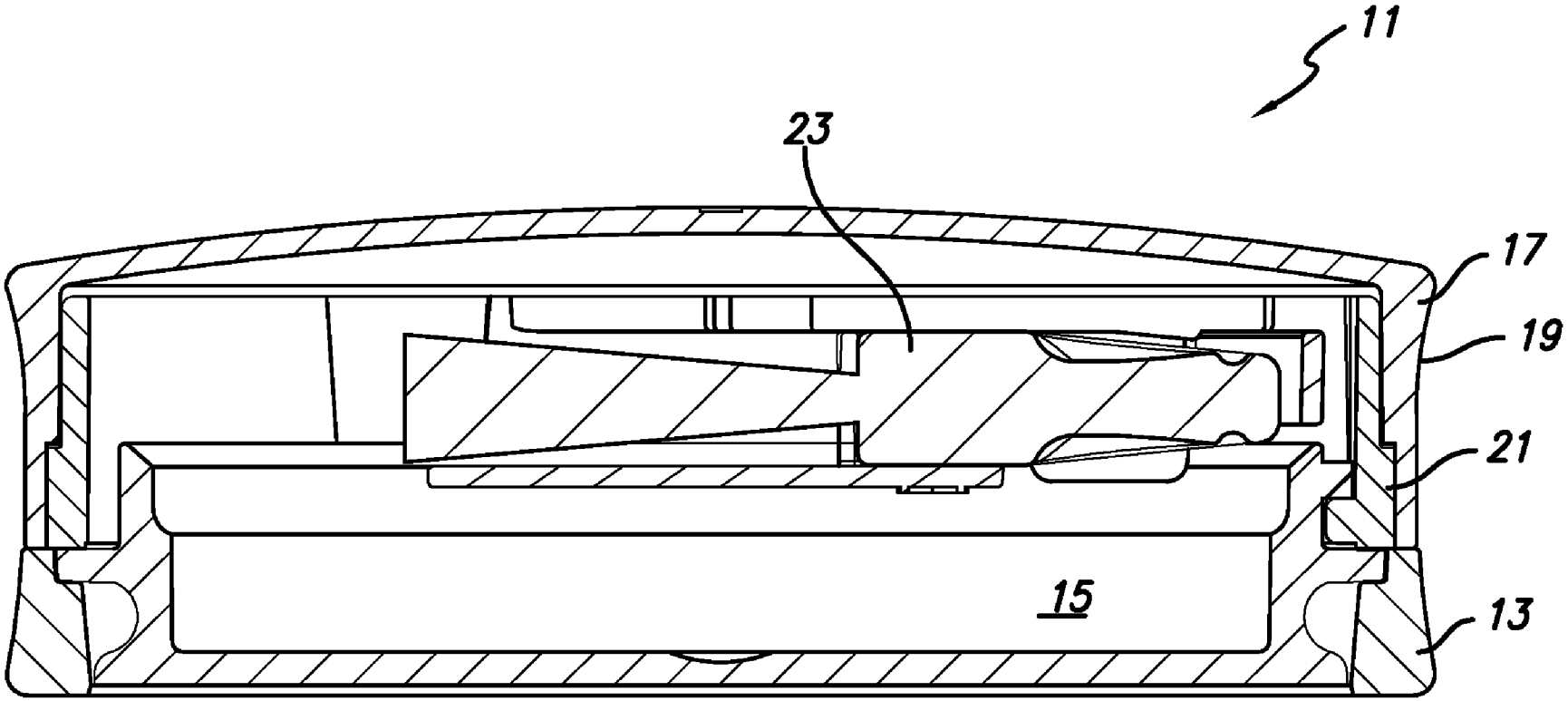
FIG. 1 is a sectional view of a cosmetic compact, including an applicator held therein.

Turning in detail to the drawings, FIG. 1 illustrates a cosmetic compact 11. The base 13 of the compact 11 includes a cosmetic well 15, which may be used to hold a pressed powder cosmetic. The cap 17 is removably affixed to the base 13 to enclose the cosmetic well 15 therein. The cap 17 includes an outer shell 19 and a cosmetic applicator holder 21 which is used to secure the cosmetic applicator 23 within the enclosure. As is discussed further herein, the applicator holder 21 engages the cosmetic applicator 23, secures it opposite and away from the cosmetic well 15, and in doing so, maintains the cosmetic applicator 23 in a predetermined orientation within the cap. Thus, when the compact 11 is in a purse, in a bag, or otherwise being transported under normal conditions, the cosmetic applicator 23 is held away from and out of the cosmetic well 15. Also, with the cosmetic applicator 23 held in a predetermined orientation, it is oriented into a desired registration with a label or other printed material on the cap.

Figure 2C:
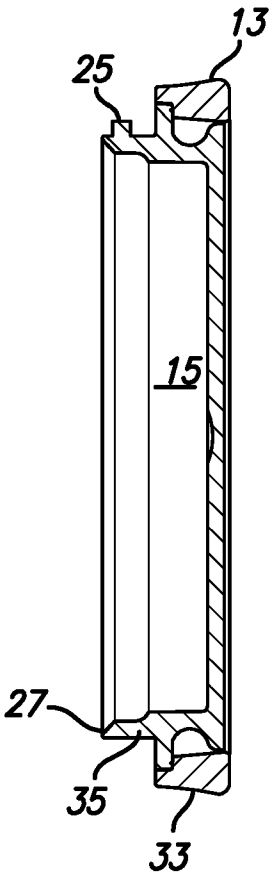
FIGS. 2A-C illustrate the base of a cosmetic compact.
Figure 2B:
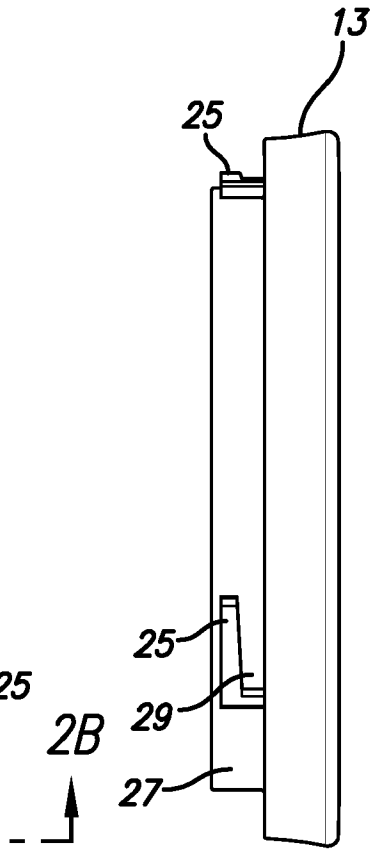
Figure 2A:
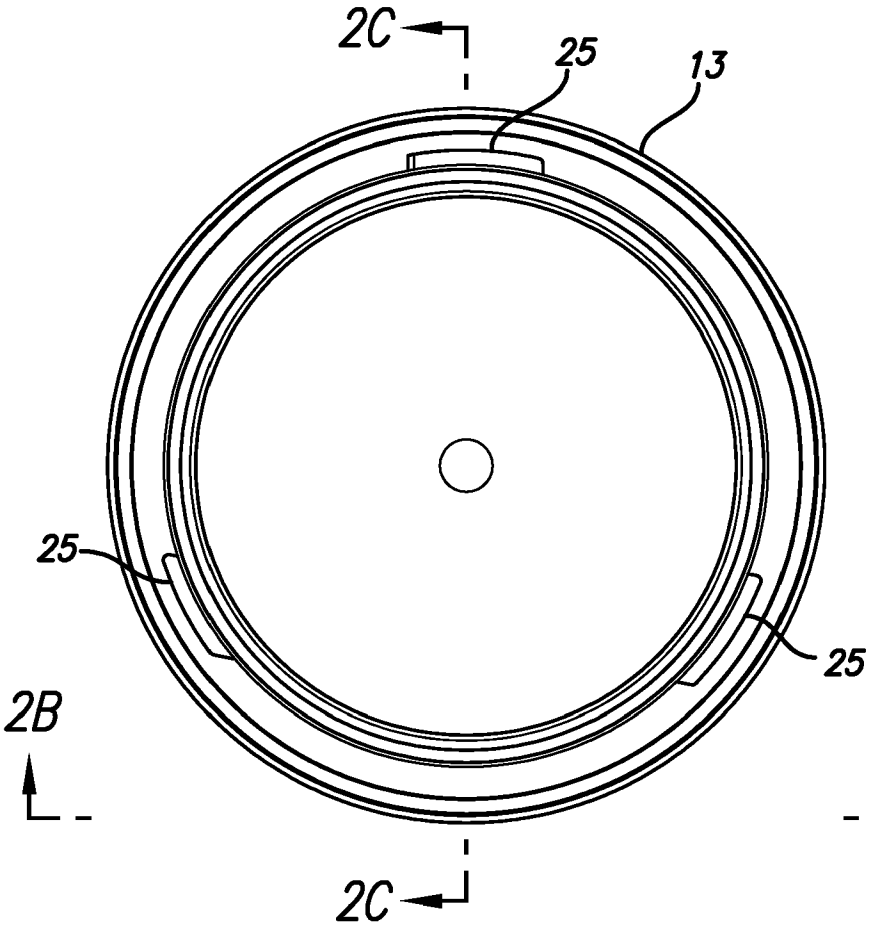

The base 13, shown in FIGS. 2A-C, is constructed with a design which is similar to compacts known in the prior art that use a base and cap secured to each other using a twist-lock connection. In practice, the cap 17 may be affixed to the base 13 in nearly any manner according to design choice, which may include a hinged connection, a snap fit, a vertical friction fit, and the like. L-shaped bosses 25 are placed equidistantly about the upper rim 27 of the base 13. FIG. 2A shows three bosses 25 on the upper rim 27 of the channel, although any number may be used. The configuration of the bosses 25 on the upper rim 27 of the base 13 is shown in FIG. 2B. The channel 29 that is formed narrows towards the closed end so that the cap 17 may be tightly secured to the base 13 following a twisting action. As seen in FIG. 2C, the base 13 is formed in two parts which are ultrasonically welded together, an outer ring 33 and an inner tray 35. The overall design of the base 13 and the method of its manufacture, are also matters of design choice. The inner tray 35 forms the cosmetic well and includes the upper rim 27 to which the cap 17 is secured. The upper rim 27 extends above the cosmetic well 15 so that when the cap 17 is attached, the cosmetic applicator 23 is more easily maintained outside of the cosmetic well 15.

Figure 3C:
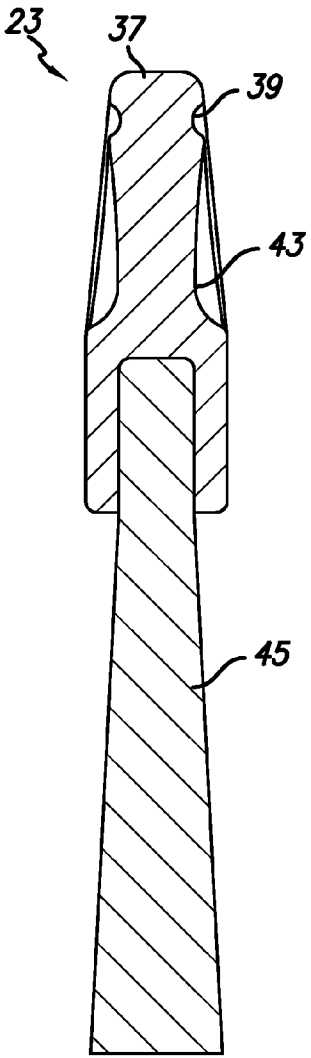
FIGS. 3A-C illustrate a cosmetic applicator.
Figure 3B:
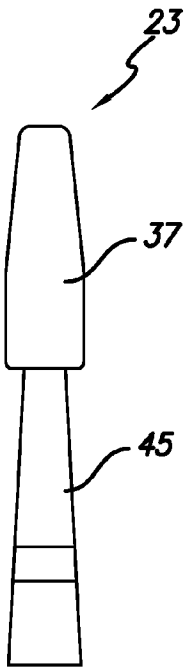
Figure 3A:
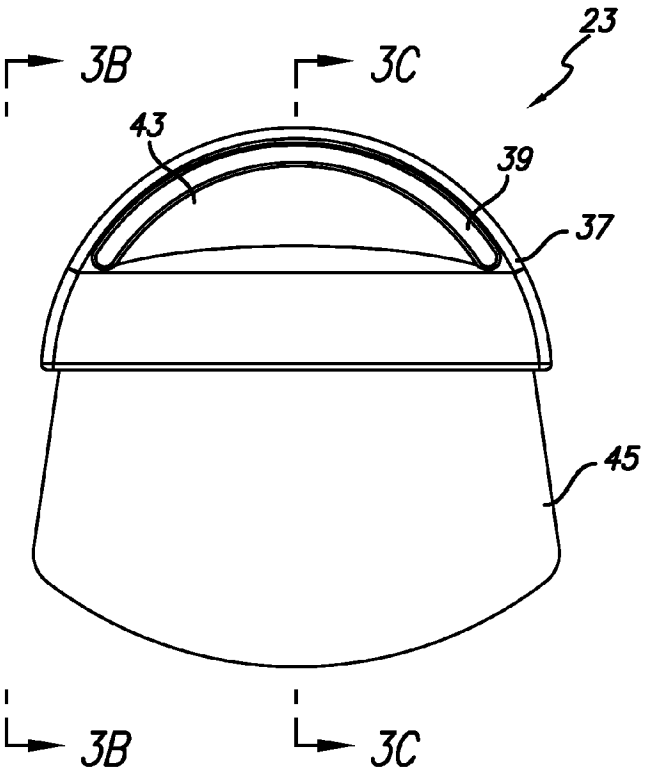

The cosmetic applicator 23 is shown in FIGS. 3A-C. The handle 37 of the cosmetic applicator 23 is semi-circular to better enable it to fit within the round shape of the compact 11. The handle 37 includes an arcuate groove 39 formed near the outer edge on each side of the handle 37, as seen in FIG. 3C. As discussed further below, this arcuate groove 39 enables the cosmetic applicator 23 to be secured to the applicator holder part of the cap and facilitates placing the cosmetic applicator 23 in a particular orientation. Also as seen in FIG. 3C, the handle 37 includes indentations 43 on either side so that it may be easily gripped between a thumb and finger during use by the consumer. The application head 45 is secured to the handle 37 and extends outwardly therefrom. The application head 45 may be constructed from any materials which are appropriate for the application of cosmetics. As shown, the overall profile of the application head 45 is narrow to better enable it to fit within the compact, yet it has a wide profile in a second dimension. Thus, the consumer benefits from a cosmetic applicator which is stored within the compact itself, and from an applicator which has both a wide and a narrow dimension, thereby allowing different types of strokes and techniques to be incorporated into the process of applying the cosmetic.

Figure 4C:
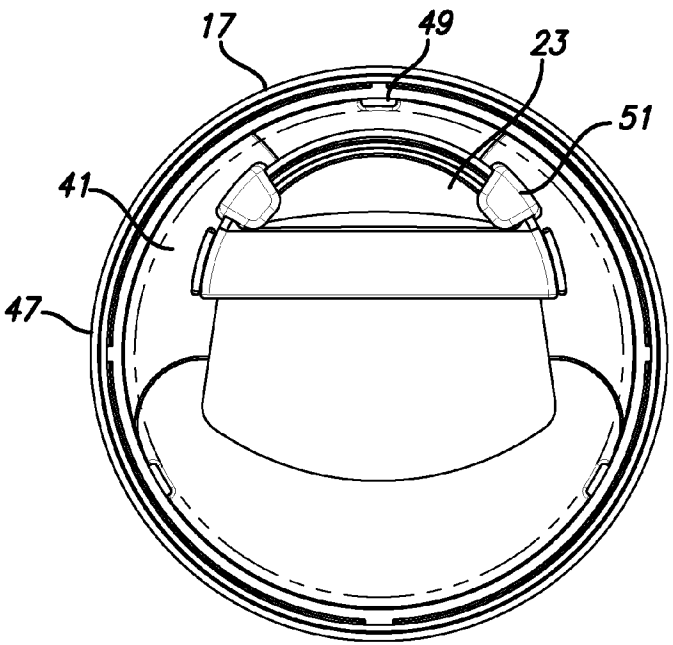
FIGS. 4A-E illustrate a cap, and components thereof, of a cosmetic compact.
Figure 4B:
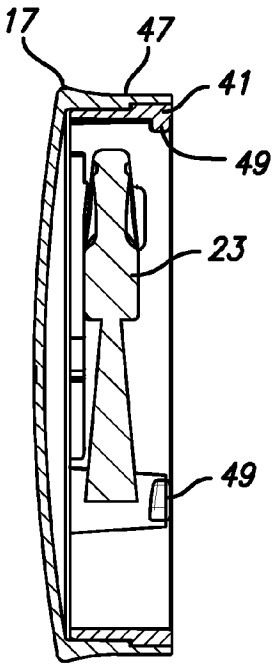
Figure 4A:
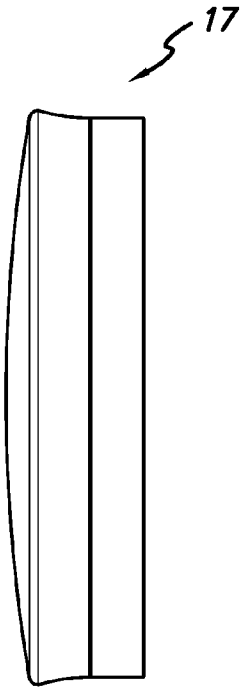

The cap 17 for the compact 11 is shown in FIGS. 4A-D. The external profile of the cap 17 is shown in FIG. 4A, and is a matter of design choice. FIG. 4B shows the applicator holder 41 held within the external shell 47 of the cap 17. The applicator holder 41 and the external shell 47 are affixed to each other in a snap fit relationship. As with other parts of the compact, the design of the cap is largely a matter of design choice. Tabs 49 are included equally spaced around the lower edge of the applicator holder 41 so that the cap 17 may be affixed to the base 13 by rotating the cap 17 so that the tabs 49 slide into the channels 29 formed on the upper rim 27 of the base 13. Both the external shell 47 and the applicator holder 41 are preferably formed of a transparent material. For example, the outer shell may be formed from an appropriate transparent material such as PETG, and the applicator holder may be formed of a clarified ABS plastic. The choice of materials is a matter of design preference, with transparency being preferred. The handle on the applicator may also be formed from a transparent material, such as clear PMMA. Again, the materials of which the handle is constructed are a matter of design choice, but the preference is for a transparent material.

The cosmetic applicator 23 is shown secure in place within the cap 17 in FIG. 4C by a pair of clips 51 which extend over and engage the handle of the applicator 23. The applicator holder 41 is shown in more detail in FIGS. 4D and 4E. The applicator holder 41 includes several ribs 53*a*, 53*b* positioned about its exterior circumference. One of the ribs 53*a* is sized differently from the other ribs 53*b* so that the applicator holder 41 may be inserted into the external shell 47 in only a single orientation. Thus, with an external shell 47 that is preprinted with a brand name or other information, the applicator holder 41 will maintain the cosmetic applicator in a predetermined registration with the print on the external shell 47. In addition, when the applicator holder 41 is snapped into the external shell 47, the ribs 53 prevent rotation of the applicator holder 41 with respect to the outer shell 47, thus maintaining the desired registration between the cosmetic applicator 23 and the printed material.

The applicator holder 41 also includes two applicator supports 55, from which the applicator clips 51 extend. The applicator supports 55 are formed as "wings" extending from opposite sides of the applicator holder 41. The applicator supports 55 provide a bearing surface which helps maintain the cosmetic applicator in place when secured by the clips 51, and also a surface against which the cosmetic applicator 23 may be pressed against when the consumer inserts or removes the cosmetic applicator 23 from the clips 51. In addition, a guide rib 57 having a slight curvature to match the handle of the cosmetic applicator is included on each of the applicator supports 55 adjacent to the applicator clip 51. These guide ribs 57 facilitate insertion of the cosmetic applicator 23 into the clips and help maintain the position of the cosmetic applicator 23 once it is secured.

Figure 4E:
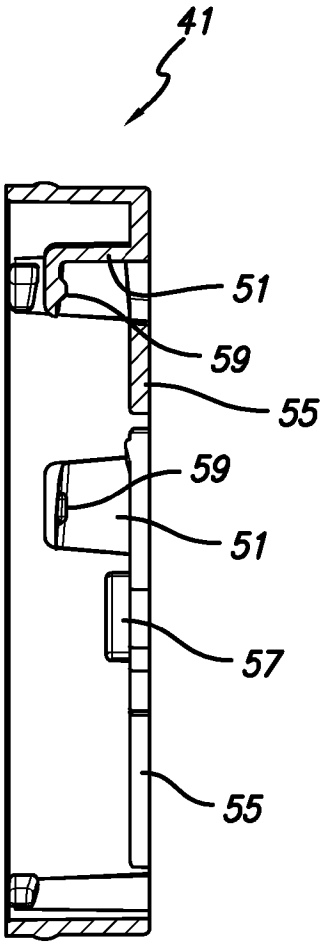
Figure 4D:
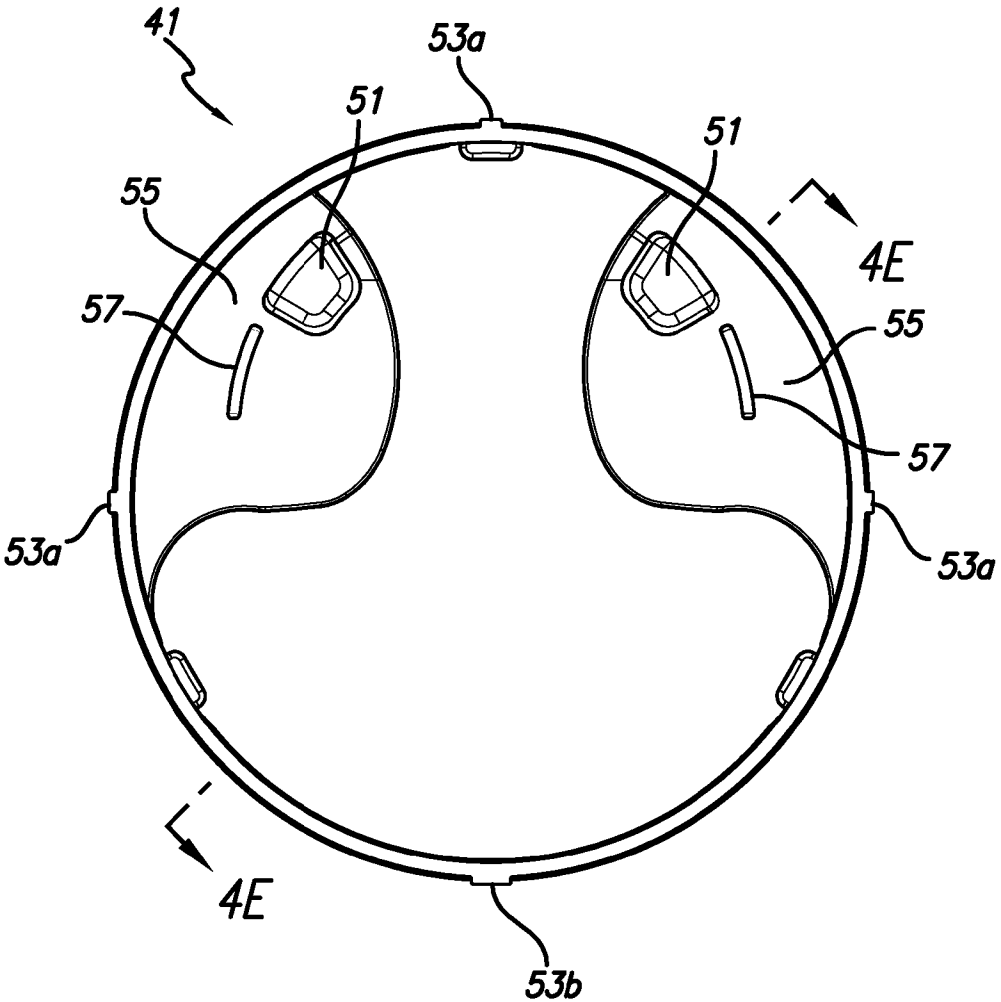

As shown in FIG. 4E, each clip 51 is generally L-shaped with boss members 59 extending down from the top portion of the clips 51. The boss members 59 are positioned to engage the arcuate groove formed in the handle of the cosmetic applicator 23. When the applicator holder 41 is formed from an appropriate plastics material, the clips 51 may be engendered with an amount of flexibility which allows for easy insertion and removal of the cosmetic applicator. In addition, appropriate choices for differences in materials between the applicator holder 41 and the cosmetic applicator handle 37 may result in a lower coefficient of friction between the holder and the handle, thereby additionally easing insertion and removal of the cosmetic applicator 23.

Thus, a cosmetic compact incorporating an applicator holder is disclosed. While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. A cosmetic compact comprising:

a circular base having a cosmetic well;

a circular cap removably affixed to the base to form a circular enclosure, the cosmetic well being disposed within the enclosure; and a cosmetic applicator disposed with the enclosure, the cosmetic applicator including a semi-circular handle, wherein the cap includes a cosmetic applicator holder disposed within the enclosure and adapted to engage the semi-circular handle and to secure the cosmetic applicator opposite the cosmetic well in a predetermined orientation and registration with respect to the cap, the cosmetic applicator holder comprising one or more applicator supports that extend radially inward to provide a bearing surface against which the cosmetic applicator may be pressed when inserting and removing the cosmetic applicator from one or more applicator clips that extend from the one or more applicator supports.

2. The compact of claim 1, wherein the applicator supports and applicator clips are adapted to engage the semicircular handle and to secure the applicator opposite the cosmetic well.

3. The compact of claim 2, the cosmetic applicator holder comprising two applicator supports and two applicator clips.

4. The compact of claim 2, wherein each applicator clip includes a boss member positioned to engage the semi-circular handle.

5. The compact of claim 4, wherein each boss member is positioned to engage a complimentary arcuate groove on the handle.

6. The compact of claim 2, wherein each applicator support includes one or more guide ribs.

7. The compact of claim 1, wherein the cap, the applicator holder, and the semi-circular handle are formed from a transparent material.

8. A cosmetic compact comprising:

a cosmetic applicator including a semi-circular handle;

a base having a cosmetic well and having a round shape; and a cap removably affixed to the base to form a round enclosure, the cosmetic well and the applicator being disposed within the enclosure, the cap including a cosmetic applicator holder adapted to releasably engage the semi-circular handle and to secure the cosmetic applicator opposite the cosmetic well in a predetermined orientation and registration with respect to the cap, the cosmetic applicator holder comprising one or more applicator supports that extend radially inward to provide a bearing surface against which the cosmetic applicator may be pressed when inserting and removing the cosmetic applicator from one or more applicator clips that extend from the one or more applicator supports.

9. The compact of claim 8, wherein the applicator supports and applicator clips are adapted to engage the semicircular handle and to secure the applicator opposite the cosmetic well.

10. The compact of claim 9, the cosmetic applicator holder comprising two applicator supports and two applicator clips.

11. The compact of claim 9, wherein each applicator clip includes a boss member positioned to engage a complimentary groove on the cosmetic applicator.

12. The compact of claim 9, wherein each applicator support includes one or more guide ribs.

13. The compact of claim 8, wherein the cap and applicator holder are formed from a transparent material.

14. The compact of claim 8, wherein the cosmetic applicator comprises a cosmetic brush.

15. The compact of claim 8, wherein the handle includes an arcuate groove adapted to be releasably engaged by the applicator holder.

16. The compact of claim 8, wherein the handle is formed from a transparent material.

17. A cosmetic compact comprising:

a circular base having a cosmetic well;

a circular cap removably affixed to the base to form a circular enclosure, the cosmetic well being disposed within the enclosure;

a cosmetic applicator disposed with the enclosure, the cosmetic applicator including a semi-circular handle, wherein the cap includes a cosmetic applicator holder disposed within the enclosure and adapted to engage the semi-circular handle and to secure the cosmetic applicator opposite the cosmetic well in a predetermined orientation and registration with respect to the cap, the cosmetic applicator holder comprising two applicator supports that extend radially inward to provide a bearing surface for the cosmetic applicator; and one applicator clip extending from each applicator support, wherein the applicator supports and applicator clips are adapted to engage the semicircular handle and to secure the applicator opposite the cosmetic well.

* * * * *

UNITED STATES PATENT AND TRADEMARK OFFICE

CERTIFICATE OF CORRECTION

PATENT NO. : 8,215,320 B2
APPLICATION NO. : 12/130194
DATED : July 10, 2012
INVENTOR(S) : David Prague et al.

It is certified that error appears in the above-identified patent and that said Letters Patent is hereby corrected as shown below:

On the Title Page:

(73), the Assignee: L'Oreal USA Products, Inc.

should read:

--(73) Assignee: L'OREAL--

Signed and Sealed this
Twenty-eighth Day of May, 2013

Teresa Stanek Rea
*Acting Director of the United States Patent and Trademark Office*